United States Patent [19]

Forbes, Jr.

[11] 4,314,643

[45] Feb. 9, 1982

[54] FLIP TOP CARTON

[75] Inventor: Hampton E. Forbes, Jr., Wilmington, Del.

[73] Assignee: Westvaco Corporation, New York, N.Y.

[21] Appl. No.: 201,278

[22] Filed: Oct. 27, 1980

[51] Int. Cl.[3] ..... B65D 5/54

[52] U.S. Cl. ..... 206/626; 229/44 CB

[58] Field of Search ..... 229/44 CB, 45 R; 206/624, 626

[56] References Cited

U.S. PATENT DOCUMENTS

| | | | |
|---|---|---|---|
| Re. 26,185 | 4/1967 | Henry . | |
| Re. 26,471 | 10/1968 | Meyers . | |
| 3,378,188 | 4/1968 | Meyers . | |
| 3,608,812 | 9/1971 | Hamilton | 229/44 CB |
| 3,616,987 | 11/1971 | Krzyzanowski | 206/626 |
| 3,680,767 | 8/1972 | De Lorenzo et al. | 229/45 R |
| 3,893,614 | 7/1975 | Meyers . | |
| 4,048,052 | 9/1977 | Tolaas | 206/625 |
| 4,083,455 | 4/1978 | Keating, Jr. | 206/625 |
| 4,113,104 | 9/1978 | Meyers | 206/626 |
| 4,215,783 | 8/1980 | VanderLugt, Jr. | 206/626 |

FOREIGN PATENT DOCUMENTS

| | | |
|---|---|---|
| 1346110 | 2/1974 | United Kingdom . |
| 1467256 | 3/1977 | United Kingdom . |

*Primary Examiner*—Stephen P. Garbe

[57] ABSTRACT

A tamperproof, reclosable flip top carton of the side loading type includes reclosure elements on the receptacle portion front wall and the cover portion front wall cover flap. The side walls of the carton are diagonally cut to abut one another when the carton is closed and to provide an opening arrangement which does not require any excessive tearing or removal of carton panels when opened.

8 Claims, 6 Drawing Figures

FLIP TOP CARTON

BACKGROUND OF INVENTION

The present invention relates to a flip top carton construction with a locking reclosure feature formed from a single paperboard blank. The carton is formed with a receptacle portion and a cover portion having downwardly extending skirt portions which telescope over the upper receptacle side and front walls when the carton is closed. In the closed condition, the skirted cover portion is detachably connected to the receptacle portion thus providing a tamperproof closure for the carton. After the carton is opened, locking means are provided on the cover portion and receptacle portion to effect the reclosure feature.

Flip top cartons are generally manufactured in one of two forms. In one such form, the panels which form the carton are laid out side-by-side on the paperboard blank. Cartons prepared from these type blanks are normally loaded while still in the form of an open blank and erected around the contents, or the cartons are pre-glued and filled from the top. However, top loading of such cartons is inconvenient and requires special machinery for forming and closing the top after loading.

In the second generally used method for manufacturing flip top cartons, the panels which form the carton are laid out end-to-end on the paperboard blank. A carton prepared from this type blank is generally side loaded at an intermediate stage of erection because the top of the carton also serves as the manufacturers joint for the carton. In general, side loading cartons are preferred because they may be manufactured on standard end seal equipment. Unfortunately, the side loading cartons of the prior art have proven to be complicated to manufacture and set up, and difficult to open because of impractical design and operating features. Accordingly, to overcome the problems with the prior art designs, the present invention provides a flip top carton which is easy to manufacture and which can readily be side loaded and sealed with only minor changes in the equipment used to fill and seal top loading cartons.

DESCRIPTION OF PRIOR ART

The prior art includes numerous examples of flip top cartons that are manufactured according to both of the two generally recognized methods. Some representative cartons of the type which are end loaded are illustrated in U.S. Pat. Nos. 3,378,188; 3,893,614; 4,083,455; 4,113,104; and 4,125,783. Meanwhile some representative cartons of the type which are side loaded are illustrated in U.S. Pat. Nos. Re. 26,185; Re. 26,471; 3,680,767; and 4,048,052. British Pat. No. 1,467,256 also shows an example of a side loaded flip top carton, and British Pat. No. 1,346,110 illustrates a closure scheme for a flat top carton that utilizes features similar to those of the present invention. Thus, although numerous carton structures of the type disclosed herein have been proposed, most of them suffer from various disadvantages and shortcomings as set forth hereinbefore.

SUMMARY OF INVENTION

The flip top carton of the present invention is of the preferred side loading type, however, it incorporates features that make it superior to the side loading flip top cartons disclosed in the prior art. The opening and reclosing panels of the carton of the present invention also function as the manufacturers joint for the carton. This arrangement provides a carton construction that will readily run on standard end seal equipment with only a slight variance in the fold sequence. Moreover, the blank structure used to construct the carton of the present invention requires a simplified glue application technique, and incorporates design refinements that reduce the number of glued panels which in prior art cartons must be ripped or removed when the carton is opened. In addition, the carton of the present invention employs a versatile and effective tamperproof closing mechanism and reclosure lock that is effective under a variety of conditions.

The above and other features of the present invention are carried out by cutting and scoring a blank of paperboard or the like to produce a flip top carton comprising a receptacle portion having front, rear, bottom and side walls, and a cover portion having at least front, top and side walls foldably hinged to the rear wall of the receptacle portion. The blank itself comprises a plurality of panels foldably connected end-to-end forming respectively, a front wall, a bottom wall, a rear wall and the panels which form the cover portion. A plurality of flaps are foldably connected to the opposite ends of the front, bottom and rear walls to form the sides of the receptacle portion and an extension is foldably attached to the end of the front wall for forming the carton manufacturers joint and reclosure locking feature. The panels which form the cover portion include front and top walls, with side walls foldably attached to the ends of the front wall and diagonally cut side wall flaps foldably attached to the ends of the top wall. The diagonal cut of the side wall flaps is angularly coordinated with similar diagonal cuts on the ends of the side wall flaps attached to the receptacle portion front wall to achieve a complementary fit when the carton is formed and closed. This arrangement assures that no part of the cover portion except for the top cover front wall becomes adhered to the receptacle portion. Further, the arrangement results in a construction wherein the front wall of the carton is not directly connected to the side walls of the carton in the region above the diagonal cuts. This feature allows the front wall to have considerably more spring back than the prior art constructions which makes opening and reclosing the carton simple and easy.

DETAILED DESCRIPTION

Figure 1:
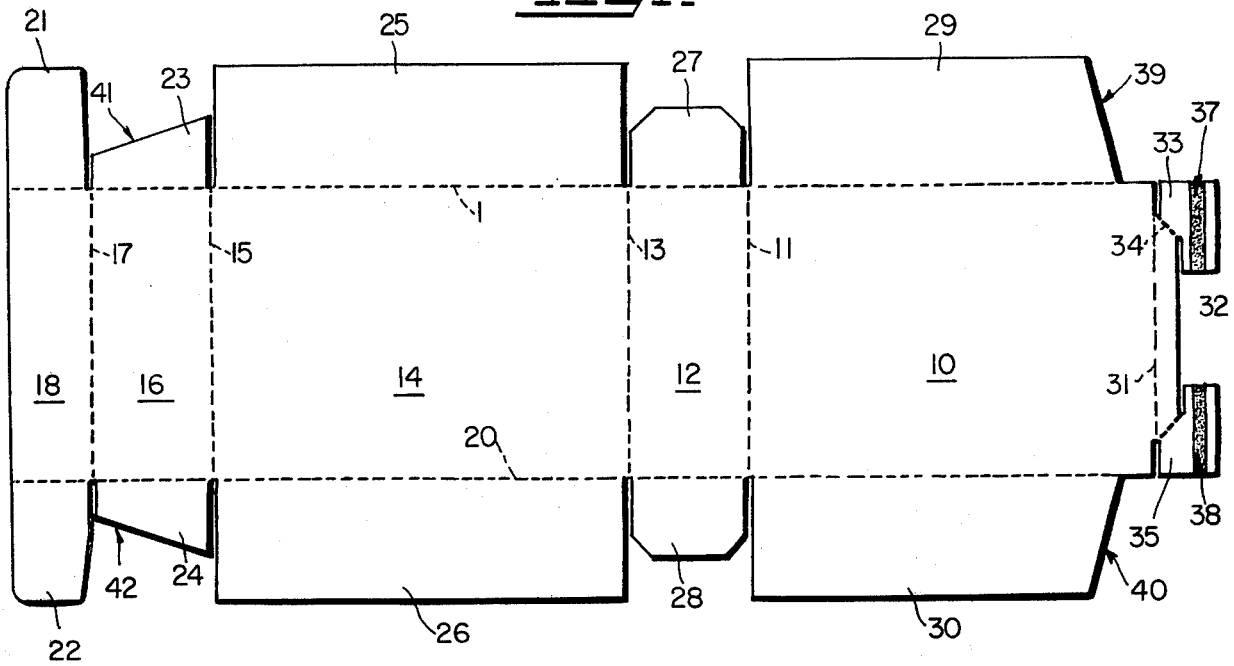
FIG. 1 is a plan view of a cut and scored blank useful for making the carton of the present invention.

The carton of the present invention is formed from a blank of cut and scored paperboard substantially as shown in FIG. 1. For this purpose, the receptacle portion of the carton is formed from a front panel 10, bottom panel 12 and rear panel 14, foldably connected end-to-end along score lines 11 and 13, and side wall flaps 25,27,29 and 26,28,30 connected to the edges of the panels 10,12,14 along fold lines 19,20. Meanwhile the flip top cover portion of the carton is formed from a top panel 16 and a cover front wall 18 foldably connected together along a score line 17 and both foldably connected to the rear panel 14 along a score line 15. The flip top cover portion also includes a pair of side wall cover panels 21,22 foldably connected to the ends of front wall 18, and a pair of reinforcing cover flaps 23,24 foldably connected to the ends of top panel 16. The reinforcing cover flaps 23,24 have diagonally cut ends 41,42 which have the same angular orientation as the diagonally cut ends 39,40 of the side wall flaps 29,30 connected to the front panel 10. Finally, the reclosure locking flaps for the carton are located at the opposite end of the blank. For this purpose a first locking flap 32 is foldably attached to the front wall 10 along a score line 31. The locking flap 32 is of tapered configuration and does not extend the full width of the front wall 10. The tapered side edges of flap 32 provide attachment points along which a pair of second locking flaps 33,35 are attached by lines of separation 34,36. These lines may be formed by perforations as shown in the drawings or by a plurality of cuts arranged along the lines 34,36. For this purpose the cut lines would be staggered along and substantially bisected by the lines 34,36. The second locking flaps 33,35 are preferably of abbreviated length and occupy space between the outer edges of front wall panel 10 to a point just inside the tapered edges 34,36 of flap 32. However, for ease of operation, the flaps 33,35 are only attached to the flap 32 along the lines of separation 34,36. This arrangement provides a more than adequate means for securely closing the carton but still allows the carton to be readily opened and reclosed as desired.

Figure 2:
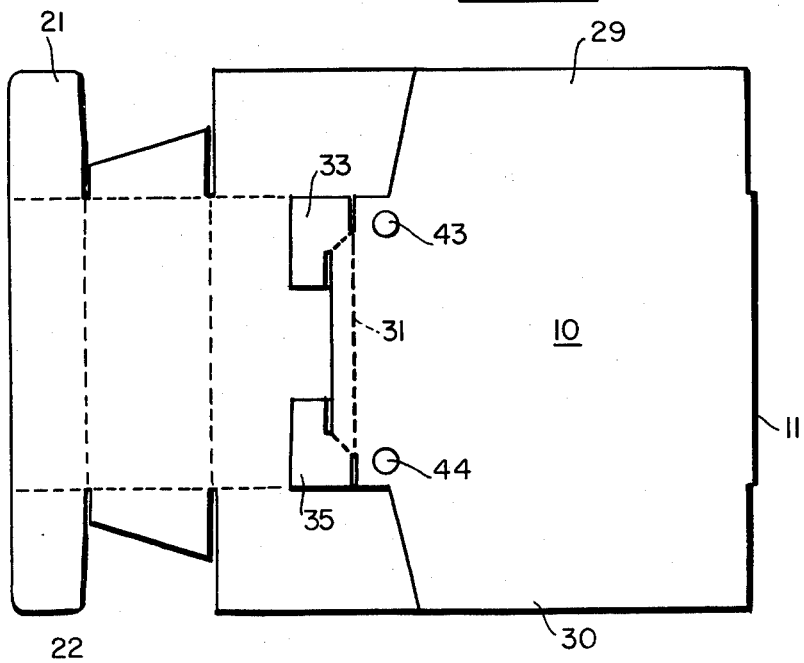
FIG. 2 shows a part of the first folding sequence in the manufacture of the carton.
Figure 3:
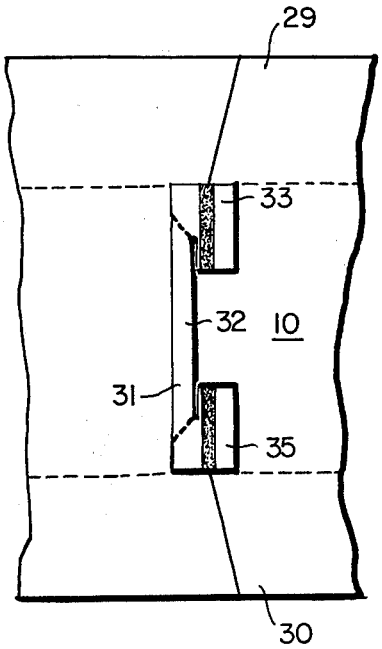
FIG. 3 shows the blank after the first folding sequence is completed.
Figure 4:
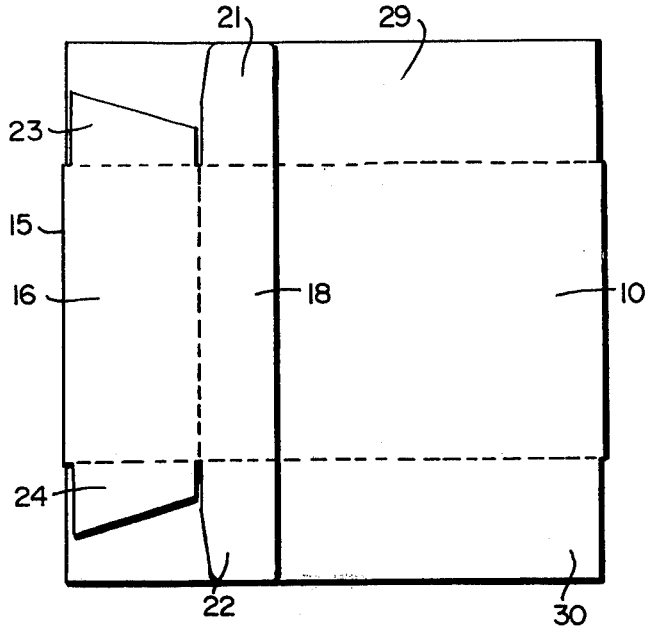
FIG. 4 shows the blank completely folded and ready to be squared and loaded from the side.

The carton may be formed as shown in FIGS. 2, 3 and 4 of the drawing by applying adhesive as shown at 37,38 of FIG. 1 to the inside of the secondary locking flaps 33,35. At the same time, adhesive spots 43,44 are applied to the outside of front panel 10 as shown in FIG. 2. The adhesive spots 43,44 are required to temporarily adhere the secondary locking flaps 33,35 to the front wall 10 while the adhesive strips 37,38 are needed to permanently adhere the secondary locking flaps 33,35 to the front wall 18 of the cover portion of the carton. FIGS. 2 and 3 show a preferred folding sequence for carrying out these steps. As the front wall 10 is folded over along score line 11, the reclosure locking flaps 32,33 and 35 are reversely folded along score line 31. This action leaves the blank in the condition shown in FIG. 3. Subsequently, when the cover panels 16 and 18 are folded over along score line 15, the blank is completed as shown in FIG. 4. In the alternative, the blank may be folded along score lines 13 and 17. Thus, as described hereinbefore, the manufacturers joint for the carton is completed and the carton is ready to be squared and loaded from the side in the most convenient manner.

Figure 5:
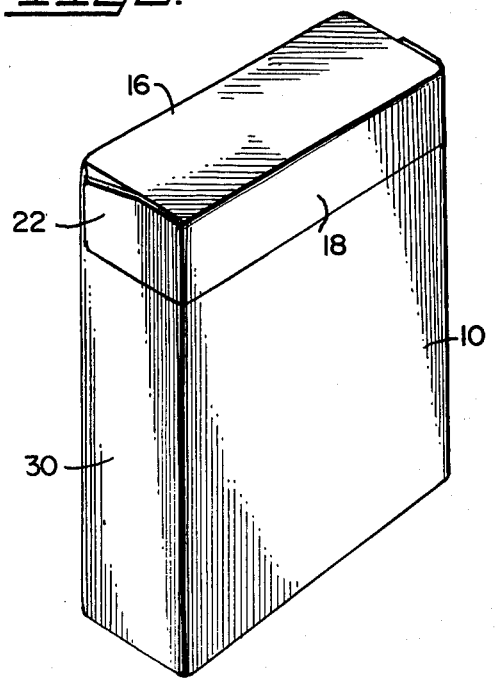
FIG. 5 is a perspective view showing the filled and sealed carton.

FIG. 5 illustrates the carton in its filled condition ready for sale. The final steps in the folding sequence for sealing the sides of the carton are as follows. First, flaps 27 and 28 attached to the bottom panel 12 are folded inwardly. Secondly, the flaps 25,26 attached to rear panel 14 are folded inwardly and adhered to flaps 27,28. Third, the diagonally cut flaps 23,24 attached to top cover panel 16 are folded inwardly over the side wall flaps 25,26, and fourth, the side wall flaps 29,30 are folded inwardly and adhered to flaps 25,26 while simultaneously the top cover side wall flaps 21,22 are folded inwardly and adhered to the diagonally cut flaps 23,24. Since the diagonal cuts 41,42 of flaps 23,24 are complementary to the diagonal cuts 39,40 of side wall flaps 29,30, no part of the cover portion becomes adhered to the receptacle portion except in the region along front wall 10 where the front cover panel 18 of the cover portion is temporarily adhered to front wall 10. Thus, the carton can be readily opened without any excessive tearing of the flaps or panels of the carton.

Figure 6:
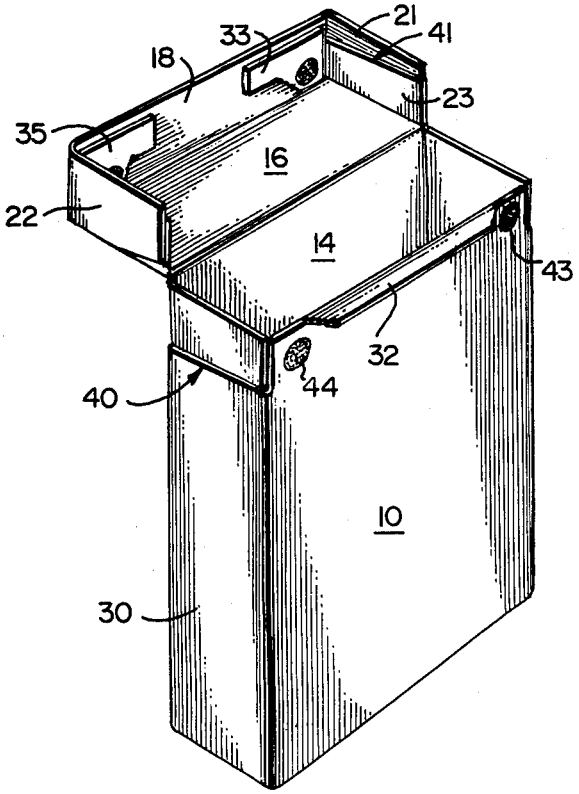
FIG. 6 is a perspective view showing the carton open.

FIG. 6 shows the carton after it has been opened. Note that the secondary locking flaps 33,35 remain attached to the top cover front panel 18 as a result of being broken away from the first locking flap 32 along the perforated lines 34,36. Similarly, note the relationship between the diagonal cuts 39,40 on side wall flaps 29,30 and the diagonal cuts 41,42 on the top cover side flaps 23,24. Upon reclosing the carton shown in FIG. 6, the first locking flap 32 readily engages the inwardly extending exposed edges of secondary locking flaps 33,35 to effectively retain the cover portion in place over the receptacle portion. Since the front wall 10 remains unattached to the carton side walls comprising flaps 25,29 and 26,30, in the region above the diagonal cuts 39,40, a desirable amount of spring back is created in the front wall which makes opening and reclosing the carton a simple and uncomplicated task.

It will be clear from a review of the above disclosure that the construction of the present invention provides a useful reclosure feature for a tamperproof carton. The carton is set up and glued in a manner unlike much of the prior art and further includes features which make the carton easier to open and more readily closed and reopened than most prior art cartons. Thus, even though only a single embodiment is fully disclosed, the invention should not be so limited since the spirit and scope of the invention is defined by the appended claims.

I claim:

1. A unitary blank of paperboard or the like for making a reclosable flip top carton including a receptacle portion comprising a front wall panel, bottom wall panel and rear wall panel connected end-to-end along parallel spaced apart fold lines, a cover portion foldably attached to said rear wall panel, said cover portion comprising a front wall cover flap, a top cover panel and a pair of side wall cover flaps foldably attached to the ends of said front wall cover flap, a plurality of side wall flaps foldably attached to the opposed free edges of said front and rear wall panels and said bottom wall panel and top cover panel, and a cover portion locking means foldably attached to said front wall, the improvement wherein the cover portion locking means comprises a first locking flap with a free outer edge and tapered side edges foldably attached to the end of said front wall panel and a pair of secondary locking flaps arranged on each side of said first locking flap and detachably connected only to the tapered side edges of said first locking flap.

2. The blank of claim 1 wherein the first locking flap does not extend the full width of the front wall panel so that its tapered side edges lie inboard of the outer edges of the front wall panel and the paired secondary locking flaps occupy the space along said front wall panel between the outer edges of the front wall panel to a point slightly inside of the tapered edges of the first locking flap.

3. The blank of claim 2 wherein the side wall flaps foldably attached to the front wall and to the top cover panel each have diagonally cut outer edges which are angularly related to be complementary with one another.

4. A reclosable, flip top carton formed from a unitary blank of paperboard or the like including a receptacle portion comprising a front wall, bottom wall, side walls and a rear wall, and a flip top cover portion and cover portion locking means foldably attached respectively to the carton rear wall and front wall, the improvement wherein the cover portion locking means comprises a first locking flap having tapered outer edges centrally positioned along the upper edge of said front wall, and a pair of secondary locking flaps of abbreviated length that occupy the space along said front wall outboard of said first locking flap and which are detachably connected only to the tapered edges of said first locking flap.

5. The carton of claim 4 wherein the flip top cover portion comprises a front wall cover flap, a top cover panel, a pair of front wall cover flap side walls and a pair of top cover panel side wall flaps.

6. The carton of claim 5 wherein the side wall flaps foldably attached to the front panel of the receptacle portion and the top cover panel of the cover portion each have diagonally cut outer edges which are angularly related to abut one another in a complementary fashion when the carton is closed.

7. The carton of claim 6 wherein the secondary locking flaps are releasably adhered to the receptacle portion front wall and permanently adhered to the cover portion front wall cover flap when the carton is closed.

8. The carton of claim 7 wherein upon opening the closed carton, the releasable connection between said secondary locking flaps and the carton front wall is broken and the detachable connection between said secondary locking flaps and the first locking flap is fractured leaving the secondary locking flaps attached to the front wall cover flap for subsequent reengagement upon reclosure of the cover portion.

* * * * *